US006098680A

United States Patent [19]

Nien

[11] Patent Number: 6,098,680

[45] Date of Patent: Aug. 8, 2000

[54] SLATS OF BAMBOO WINDOW SHADE AND METHOD FOR MAKING SAME

[75] Inventor: Ming Nien, Chang Hua Hsien, Taiwan

[73] Assignee: Nien Made Enterprise Co., Ltd, Chang Hua Hsien, Taiwan

[21] Appl. No.: 09/386,451

[22] Filed: Aug. 31, 1999

[51] Int. Cl.[7] ..... B27M 1/00

[52] U.S. Cl. ..... 144/380; 144/3.1; 144/5; 144/333; 144/346; 144/348; 144/350; 144/351; 144/364; 144/367; 144/369; 156/250; 156/296; 428/105; 428/106; 428/378

[58] Field of Search ..... 144/3.1, 5, 6, 333, 144/329, 345, 346, 349, 250, 363, 367, 364, 369, 380; 428/57, 105, 106, 114, 378; 156/62.2, 62.4, 62.6, 250, 296

[56] References Cited

U.S. PATENT DOCUMENTS 5,896,903 4/1999 Chen et al. ..... 144/380

*Primary Examiner*—W. Donald Bray
*Attorney, Agent, or Firm*—Browdy and Neimark, P.L.L.C.

[57] ABSTRACT

A method is used to make bamboo slats which are intended for use in making a blind. The method comprises a first step in which a bamboo stem is split into a plurality strips. The bamboo strips are barked, polished, and bleached before they are adhered side by side to form a base plate. A plurality of base plates are adhered in a stack to form a rectangular bamboo block having bamboo fibers which are arranged in an interlacing manner. The bamboo block is sliced into a plurality of bamboo slat, with each having bamboo fibers which are arranged in the interlacing manner.

4 Claims, 4 Drawing Sheets

SLATS OF BAMBOO WINDOW SHADE AND METHOD FOR MAKING SAME

FIELD OF THE INVENTION

The present invention relates generally to a bamboo window shade, and more particularly to slats of the bamboo window shade and a method for making the slats of the bamboo window shade.

BACKGROUND OF THE INVENTION

With a view to preventing the environmental pollution caused by the production of slats of the conventional Venetian blind, the U.S. Pat. No. 5,896,903 discloses a method for making the Venetian blind slats of bamboo. The method includes the first step in which a bamboo stem is split into a plurality of bamboo strips. The bark of the bamboo strips is taken off before the bamboo strips are bleached and sterilized in the boiling hydrogen peroxide (diluted) for eight hours. Thereafter, the chemically-treated bamboo strips are dried by baking and are then polished. The bamboo strips are adhered along the longitudinal sides under pressure to form a rectangular body, which is properly dressed and is then sliced into slats. The slats are polished, coated, and drilled before they are ready for use in making a Venetian blind.

Such a prior art method for making bamboo slats as described above is defective in design in that the rectangular body is sliced along the longitudinal direction thereof into the slats, which are all similar in fiber orientation and are therefore susceptible to deformation under heat or pressure.

SUMMARY OF THE INVENTION

It is the primary objective of the present invention to provide a bamboo slat which is resistant to deformation under heat or pressure.

It is another objective of the present invention to provide a bamboo slat which has an esthetic arrangement of fibers.

In keeping with the principle of the present invention, the foregoing objectives of the present invention are attained by a method for making bamboo slats which are used in making a blind. The method includes a first step in which a bamboo stem of a length is split into a plurality of bamboo strips, which are then barked. The barked strips are sterilized and bleached by the sulfur steam. The sterilized and bleached strips are dried before the strips are adhered together along the longitudinal sides thereof to form a base plate. A plurality of base plates are stacked and glued together in an alternating manner to form a rectangular bamboo block body, which is sliced into a plurality of slats having a predetermined thickness. The slats are coated with lacquer and then air-dried. The slats so made are resistant to deformation at a temperature as high as 70 degrees in Celsius.

DETAILED DESCRIPTION OF THE INVENTION

As shown in FIGS. 1–5, a method embodied in the present invention is used to make bamboo slats which are intended for use in making a blind.

Figure 1:
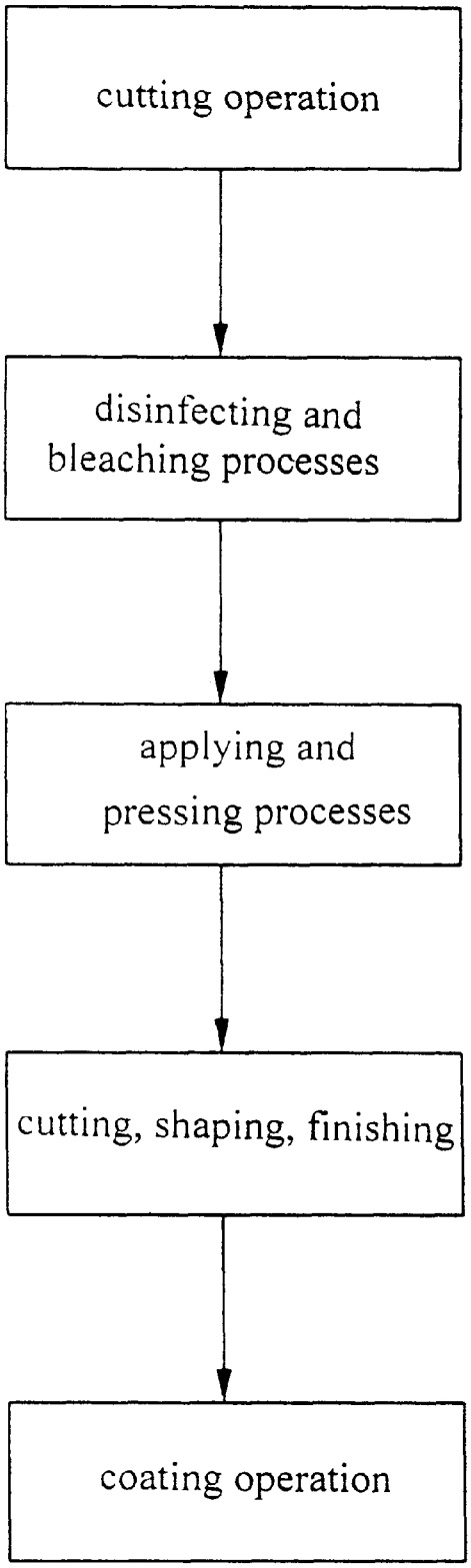
FIG. 1 shows a process flow chart of the present invention.
Figure 2:
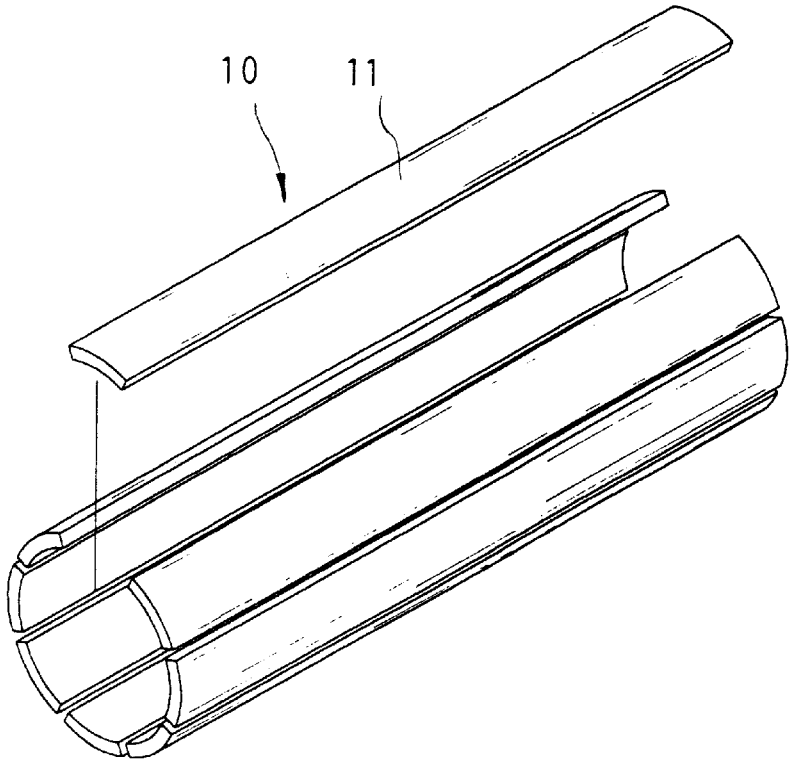
FIG. 2 shows a schematic view of a bamboo stem being split into a plurality of bamboo strips according to the method of the present invention.
Figure 3:
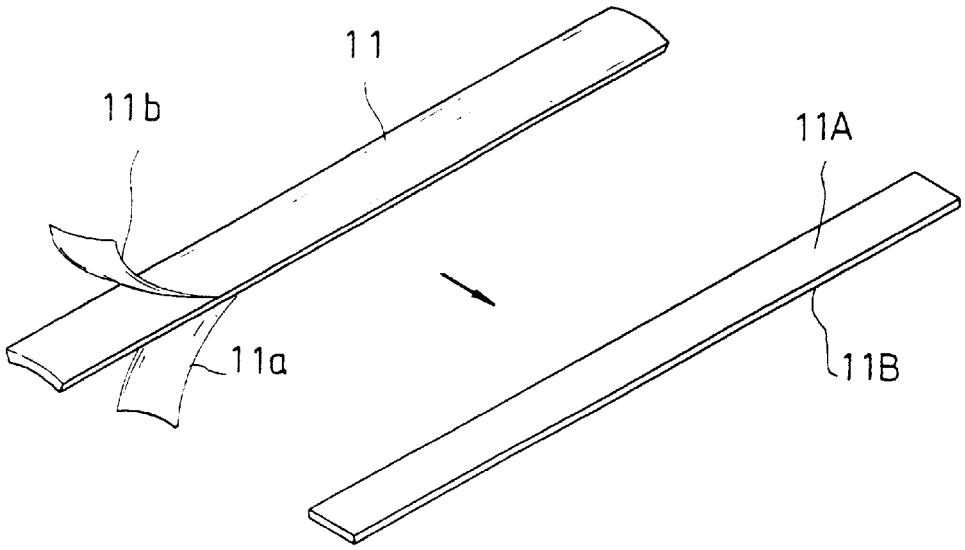
FIG. 3 shows a schematic view of dressing the bamboo strips according to the method of the present invention.

As shown in FIG. 2, the method of the present invention includes a first step in which a bamboo stem 10 of a predetermined length is split into a plurality of strips 11, which are then barked 11*a* and 11*b*, as shown in FIG. 3. The barked strips are dressed such that the strips have a smooth longitudinal surface 11A and a smooth longitudinal side 11B.

Figure 4:
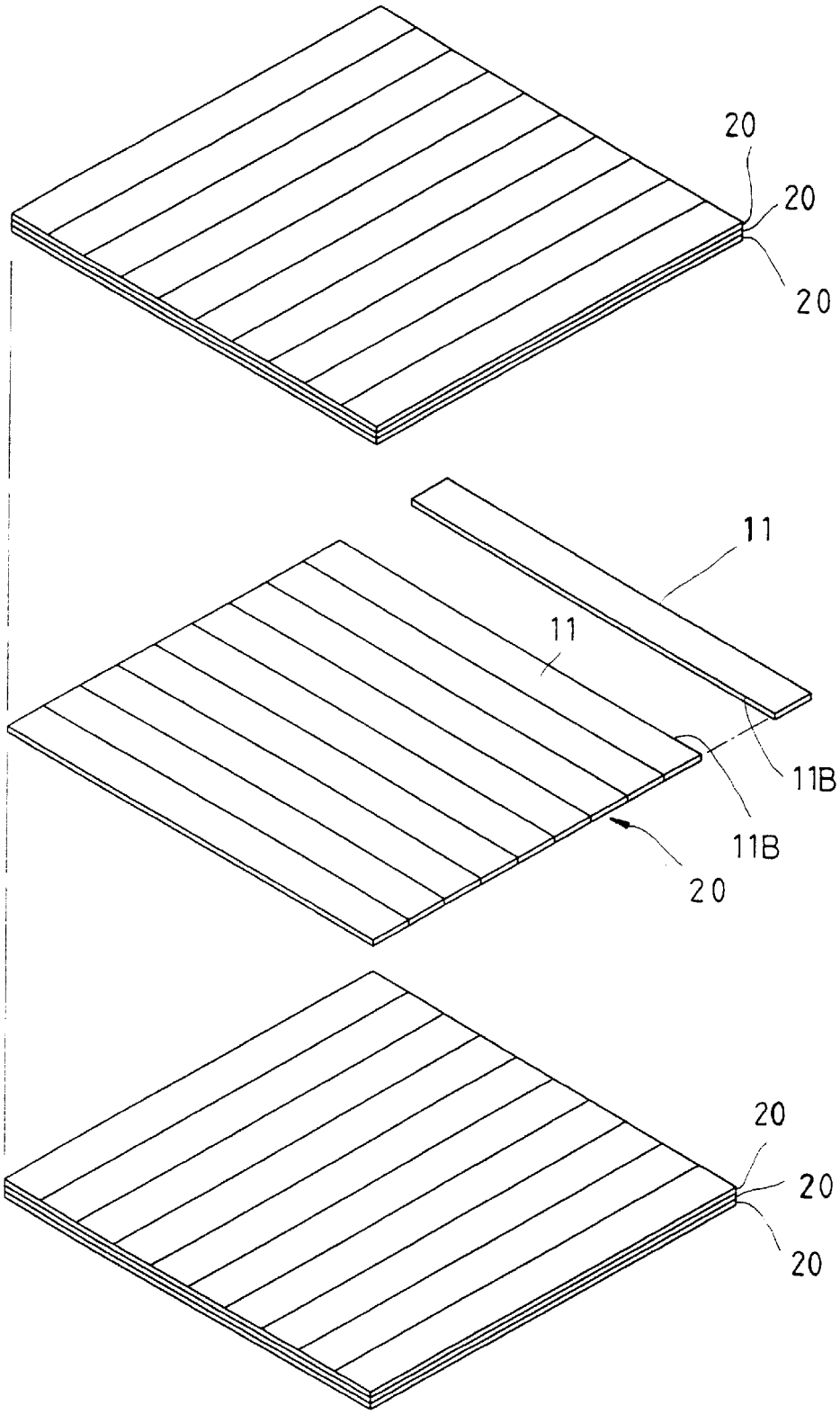
FIG. 4 shows a schematic view of making a base plate of the method of the present invention.
Figure 5:
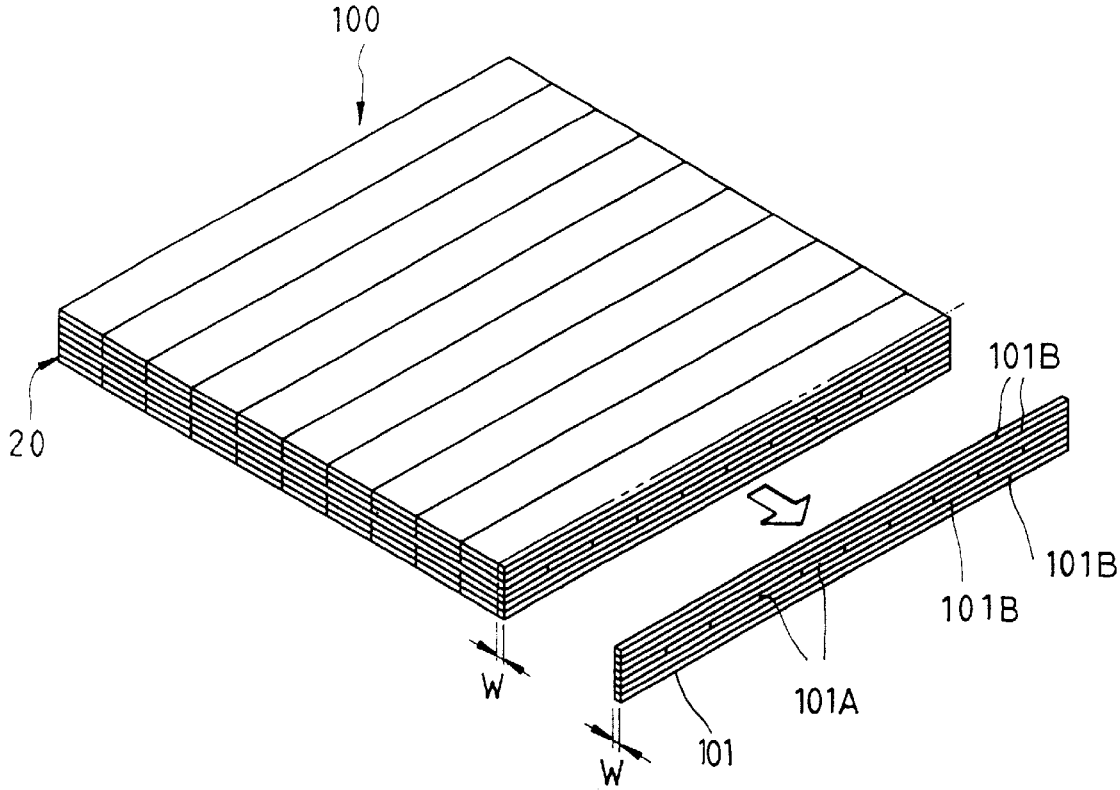
FIG. 5 shows a schematic view of a bamboo block body being sliced into bamboo slats according to the method of the present invention.

The dressed strips 11 are bleached and fumigated by the sulfur steam for up to 12 hours or longer. Thereafter, the strips 11 are dried by baking and are coated with a layer of adhesive. As shown in FIG. 4, a base plate 20 is formed of a plurality of the strips 11, which are joined together side by side in such a manner that the longitudinal sides 11B of the strips 11 are adhered. A plurality of base plates 20 are then adhered in a stack to form a rectangular bamboo block 100, as shown in FIG. 5. The rectangular bamboo block 100 has bamboo fibers which are arranged in an alternating manner. The rectangular bamboo block 100 of the preferred embodiment of the present invention is composed of seven base plates 20. The first, the second, and the third base plates 20 are adhered in a stack such that the bamboo fibers are all arranged horizontally, and that the bamboo fibers of the fourth base plate 20 are arranged longitudinally, and further that the bamboo fibers of the fifth, the sixth, and the seventh base plates 20 are all arranged horizontally. These base plates 20 are pressed together by pressure.

As illustrated in FIG. 5, the bamboo block 100 is sliced into a plurality of bamboo slats 101, with each having a predetermined thickness W, a plurality of longitudinally-oriented fibers 101A, and a plurality of horizontally-oriented fibers 101B.

The bamboo slats 11 are polished before they are coated with lacquer. Finally, the coated bamboo slats 11 are air-dried.

The method of the present invention has advantages over the prior art T method. In the first place, the bamboo slats 101 made by the method of the present invention are relatively more resistant to deformation in view of the fact that the bamboo slats 101 of the present invention have bamboo fibers which are arranged in an interlacing manner. In other words, the bamboo slats 101 made by the method of the present invention are relatively more durable than those which are made by the prior art method. For example, the bamboo slats 101 of the present invention are resistant to deformation even at a temperature as high as 70 degrees in Celsius. Moreover, the bamboo slats 101 of the present invention are versatile in fiber orientation in view of the fact that the base plates 20 of the present invention can be adhered in a stack in a variety of ways.

The embodiment of the present invention described above is to be regarded in all respects as being merely illustrative, and not restrictive.

Accordingly, the present invention may be embodied in other specific forms without deviating from the spirit thereof. The present invention is therefore to be limited only by the scopes of the following appended claims.

What is claimed is:

1. A method for making bamboo slats intended for use in making a blind, said method comprising the steps of:

(a) splitting a bamboo stem of a length into a plurality of strips;

(b) barking and polishing the strips such that the strips have smooth longitudinal surfaces and smooth longitudinal sides;

(c) fumigating and bleaching the polished strips;

(d) drying the fumigated and bleached strips by baking;

(e) coating the dried strips with a layer of an adhesive before a predetermined number of the coated strips are joined together side by side such that the longitudinal sides of the coated strips are adhered to result in the formation of a base plate;

(f) joining together a plurality of the base plates in a stack to form rectangular bamboo block having bamboo fibers which are arranged in an interlacing manner;

(g) slicing the bamboo block into a plurality of bamboo slats, with each having a thickness; and (h) coating the bamboo slats with lacquer, and air-drying the coated bamboo slats.

2. The method as defined in claim 1, wherein the strips are fumigated and bleached by sulfur in the step (c).

3. The method as defined in claim 2, wherein the strips are fumigated and bleached for up to 12 hours or longer.

4. The method as defined in claim 1, wherein a plurality of the base plates are joined together in a stack to form the bamboo block under pressure in the step (f).

* * * * *